US007213533B2

(12) United States Patent
Gonzales

(10) Patent No.: US 7,213,533 B2
(45) Date of Patent: May 8, 2007

(54) FOLDABLE WINDSHIELD FOR T-TOP WATERCRAFT

(76) Inventor: Richard Gonzales, 2780 Palmetto Hall Blvd., Mt. Pleasant, SC (US) 29466

( * ) Notice: Subject to any disclaimer, the term of this patent is extended or adjusted under 35 U.S.C. 154(b) by 0 days.

(21) Appl. No.: 11/219,217

(22) Filed: Sep. 2, 2005

(65) Prior Publication Data

US 2007/0051295 A1 Mar. 8, 2007

(51) Int. Cl.
*B63B 17/00* (2006.01)

(52) U.S. Cl. ..... 114/361

(58) Field of Classification Search ..... 114/361
See application file for complete search history.

(56) References Cited

U.S. PATENT DOCUMENTS

| | | | | |
|---|---|---|---|---|
| 3,214,215 | A * | 10/1965 | Hansen | 296/91 |
| 4,151,620 | A | 5/1979 | Heuzonter | |
| 4,199,163 | A | 4/1980 | Nelson et al. | |
| 4,570,991 | A | 2/1986 | Lystad | |
| 4,926,782 | A | 5/1990 | Lacy | |
| 5,195,797 | A | 3/1993 | Hobbs | |
| 5,203,277 | A | 4/1993 | Norman | |
| 5,244,244 | A | 9/1993 | Gute et al. | |
| 5,433,417 | A | 7/1995 | Schmidt et al. | |
| 5,505,156 | A | 4/1996 | Briggs | |
| D410,890 | S | 6/1999 | Consaul | |
| 5,950,366 | A | 9/1999 | Uhlmeyer | |
| 5,954,385 | A * | 9/1999 | Moore et al. | 296/96.2 |
| 6,223,680 | B1 * | 5/2001 | Frink et al. | 114/361 |
| D467,860 | S | 12/2002 | Aube et al. | |
| 6,637,363 | B2 | 10/2003 | Schmitt et al. | |
| 6,647,914 | B1 | 11/2003 | Gerhardinger et al. | |
| 2003/0110718 | A1 | 6/2003 | Boisvert | |
| 2005/0042457 | A1 | 2/2005 | Miller et al. | |

OTHER PUBLICATIONS

Westedge, www.westedge.com/flexfold.htm, way back machine, http://web.archive.org, Jun. 28, 2002.*
www.sdplastics.com/livinghinges.html.

* cited by examiner

*Primary Examiner*—Stephen Avila
(74) *Attorney, Agent, or Firm*—Harleston Law Firm LLC

(57) ABSTRACT

A foldable windshield device for removable attachment to a T-top of a motorized watercraft includes:

(a) a lower windshield portion including at least one lower attachment mechanism;

(b) a foldable upper windshield portion including at least one detachable upper attachment mechanism; and (c) a waterproof, durable, flexible, substantially transparent hinge connecting the lower windshield portion to the upper windshield portion;

wherein the upper and lower windshield portions are detachably attachable to poles of the T-top, and the upper windshield portion is detachable from the T-top and foldable over the lower windshield portion.

17 Claims, 4 Drawing Sheets

FOLDABLE WINDSHIELD FOR T-TOP WATERCRAFT

BACKGROUND OF THE INVENTION

1. Technical Field

The present invention relates to a removable, foldable front windshield device for attachment to a T-top of a motorized watercraft or the like, more particularly a windshield device comprising a fold-down upper windshield portion with attachment mechanisms for detachable attachment to support poles of the T-top.

2. Background Information

There is nothing like sitting or standing in a motorboat traveling at a high-speed over the water with the wind whipping through your hair. After awhile though, the sea spray and flying insects striking you in the face as the boat bounces up and down over the waves can become inconvenient and occasionally even hazardous.

Popular center console style motorboats are often enhanced by adding a T-top to help shield the occupants from overhead sun, wind, and precipitation. While popular, the T-top affords little protection from the elements coming from the front of the boat while the boat is underway. Many boaters augment the T-top with custom windbreaks made from clear soft plastic film, usually installed by marine upholsterers. These film windshields are typically laced on with cord and cannot be removed easily. They typically last only a few seasons before becoming cloudy and weather-beaten. They are also difficult to see through at night because of light refracting through slight wrinkles in the fabric due to its stretchiness. Once they are installed, they cannot be removed to let in desirable breezes. Some boat owners have zippers custom-installed to allow the windshield to be "opened". Once again this custom procedure takes the boat out of service while the zippers are installed. It is not unusual for these zippers to corrode and jam under saltwater conditions. In any case, the addition of the custom-made soft windshield requires the boat to be unavailable while the piece is being created. Such custom pieces are difficult or impossible to remove, particularly over open water. Since they are susceptible to degradation by the elements, they must periodically be replaced.

The present invention provides a removable windshield device with a fold-down, rigid upper windshield portion for attachment to a T-top. With this device, the user can either experience the wind whipping by when the windshield device is in a folded position, or have the protection afforded by a windshield when the windshield device in its open position. This universal device can be fitted by the consumer to essentially any T-top with a few simple tools in a matter of minutes. The installation requires no permanent modifications or drilling into the T-top, so the structure is not compromised. When protection from the elements is needed, the windshield device of the present invention can be deployed to the up, open position in seconds. When a breeze through the cockpit is desired, the present windshield device can be folded down to allow for airflow. The windshield device of present invention is constructed using non-corroding materials, such as high strength plastics and stainless steel hardware to assure an extended working life.

BRIEF SUMMARY OF THE INVENTION

The present invention is a foldable front windshield device for removable attachment to a T-top of a motorized watercraft or the like. The windshield device comprises:

(a) a lower windshield portion comprising at least one lower attachment mechanism;

(b) a foldable upper windshield portion comprising at least one detachable upper attachment mechanism; and (c) a waterproof, durable, flexible, substantially transparent hinge connecting the lower windshield portion to the upper windshield portion;

wherein the upper and lower windshield portions are detachably attachable to at least one pole of the T-top, and the upper windshield portion is detachable from the T-top and foldable over the lower windshield portion.

Advantages of the windshield device of the present invention include the following:

1) shields occupants of the watercraft from salt spray, flying bugs, and rain, hail, and other inclement weather;
2) versatile, in that an upper portion of the windshield folds down for those occasions when a shield is not desired;
3) universal fit; fits a variety of T-top and watercraft models;
4) removable, so it need not be employed during fair weather;
5) waterproof and can be rapidly deployed on the open water;
6) the windshield portions may be tinted to provide some protection from ultraviolet light; and
7) the position of the windshield device in the space over the watercraft's center console can be adjusted somewhat by sliding it up or down the T-top poles.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
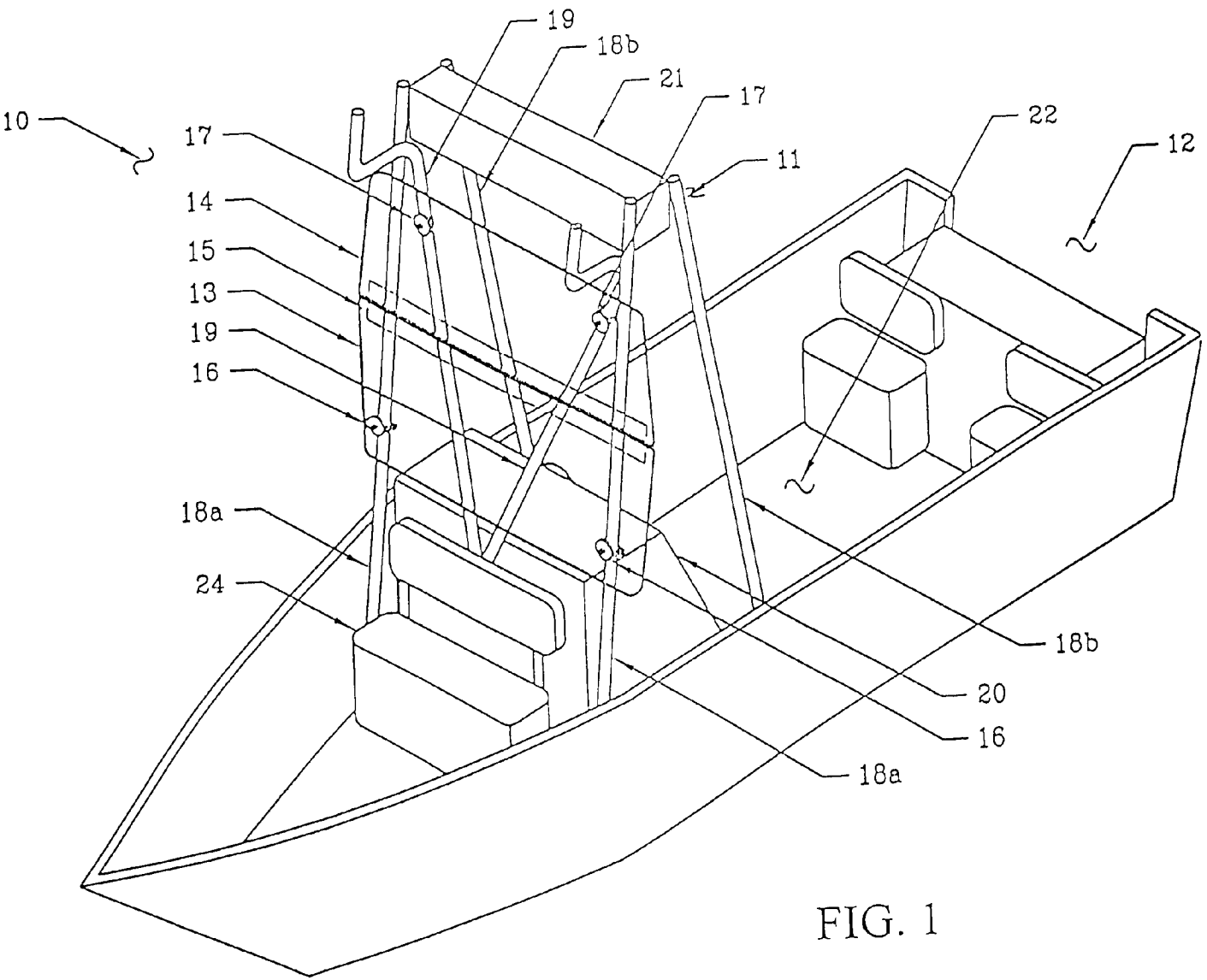
FIG. 1 is a front perspective view of a foldable windshield device according to the present invention, shown in an open position on a T-top watercraft.

In the following description, like reference characters designate like or corresponding parts throughout the several views. Also, in the following description, it is to be understood that such terms as "front," "back," and the like are words of convenience and are not to be construed as limiting terms. Referring in more detail to the drawings, the invention will now be described.

Turning first to FIG. 1, a removable, foldable windshield device according to the present invention, generally referred to herein as 10, is shown attached to a T-top 11 in the front of a motorized watercraft 12. In the embodiment depicted in FIG. 1, the windshield device 10 includes a lower windshield portion 13 comprising two lower attachment mechanisms 16, and an upper windshield portion 14 comprising two upper, detachable attachment mechanisms 17. In the embodiment depicted in FIG. 1, the upper windshield portion 14 and the lower windshield portion 13 are about the same size and shape as one another, though they need not be.

Continuing with FIG. 1, the windshield device 10 also includes a waterproof, durable, flexible, substantially transparent hinge 15 between the lower windshield portion 13 and the upper windshield portion 14. The hinge 15 connects the adjacent windshield portions 13, 14, with the upper windshield portion 14 above the lower windshield portion 13 when the windshield device 10 is in place on the watercraft. The hinge 15 may be transparent, translucent, or opaque, and is preferably a longitudinally extending hinge by which the upper windshield portion 14 can be folded down to closely overlie the lower windshield portion 13. The upper windshield portion 14 is thus rotatable about the lower windshield portion. The hinge 15 preferably extends substantially the length of the two windshield portions 13, 14, which are preferably generally rectangular in shape and substantially the same length as one another.

The upper and lower windshield portions 13, 14 are preferably made of transparent plastic, polycarbonate (preferred), or shatterproof, tempered glass or glass laminate that is suitable for use on a watercraft. Since the hinge and windshield material are both substantially transparent, occupants of the watercraft can easily see through the entire windshield device 10. The windshield material must be resistant to ultraviolet radiation and salt water corrosion over time. The windshield portions may be tinted with a UV coating to provide protection from ultraviolet light rays. The edges of generally rectangular-shaped glass windshield portions are smoothly ground for safety.

The windshield portions 13, 14 are preferably substantially planar so that the upper windshield portion can fit smoothly against the lower windshield portion. The substantially straight side edges of the upper windshield portion are preferably not curved or bent forward or rearward, nor do the windshield portions comprise side panels, for the same reason. The four corners of each generally rectangular-shaped windshield portion are preferably curved but not bent forward or backward (out of the plane of the windshield portion). There is no need for a frame around the edges of the windshield portions 13, 14. When the upper windshield portion 14 is folded down, it lies generally on top of the lower windshield portion 13. When the windshield device 10 is in the open position, the lower edge of the upper windshield portion 14 is adjacent an upper edge of the lower windshield portion 13, with the hinge 15 between the two windshield portions 13, 14. When the windshield device 10 is in the open position, as shown in FIG. 1, the windshield device 10 is substantially planar. It therefore fits between the two parallel front outer poles 18*a* and against the planar front surface of the center console 20, or wheelhouse, and does not interfere with seating on any bench 24 in front of the console 20. Although the position and size of center consoles vary from boat to boat (e.g., a 19 footer vs. a 30 foot long boat), the mounting mechanism of the windshield device 10 self-adjusts to fit the various models.

In an open position, the detachable upper attachment mechanisms 17 are preferably attached to a different two T-top poles than the lower attachment mechanisms 16. In an open position, the detachable upper attachment mechanisms 17 are each attached to one of two inner ones 19 of the poles of the T-top 11, and the lower attachment mechanisms 16 are each removably attached to one of two outer ones 18 of the poles of the T-top, the inner T-top poles 19 being closer to a longitudinal centerline of the watercraft 12 than the outer T-top poles 18.

The windshield device 10 may occupy substantially all of the front space between the top of the console 20 and the top of the T-top front outer poles 18*a*, or just a portion of the front space. In the latter case, the user can position the windshield device 10 as desired in the front space, according to where along the T-top outer poles 18*a* the lower attachment mechanisms 16 are placed. The lower attachment mechanisms 16 are slidable up or down the T-top poles, particularly in the T-top models with substantially vertical with the poles 18, 19. Once the desired position is reached, the attachment mechanisms 16, 17 are tightened. The side edges of the windshield portions preferably project beyond the T-top front outer poles 18*a* and the sides of the console 20 for added protection. Of course, the side edges of the windshield do not project out farther than the sides of the hull.

Figure 2:
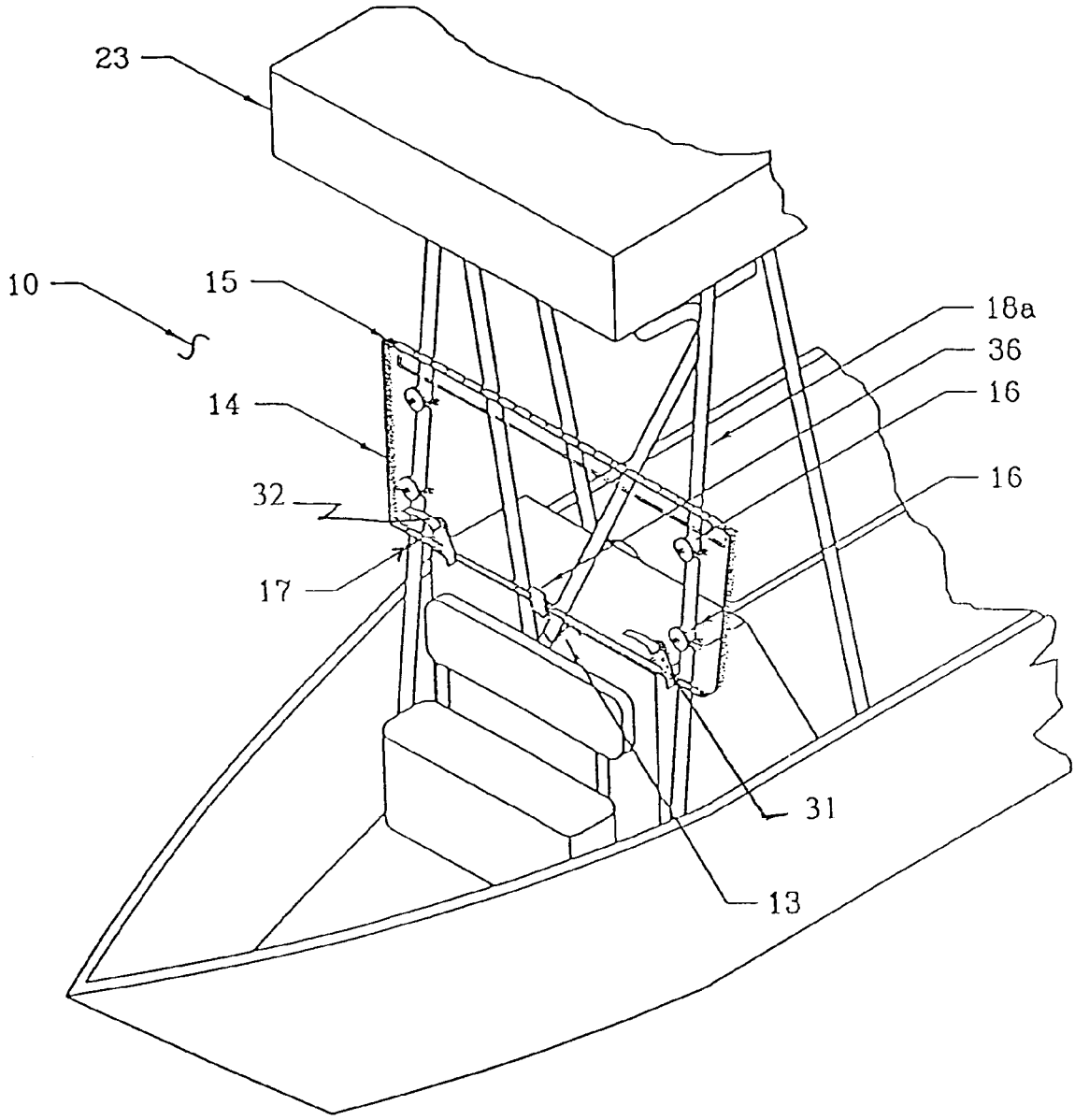
FIG. 2 is a front perspective view of foldable windshield device according to the present invention, shown in a folded position on a T-top watercraft.

Referring to FIG. 2, the upper windshield portion 14 is foldable over an outer surface of the lower windshield portion 13. By "outer surface" is meant the face of the lower windshield portion 13 that faces forward when the windshield device 10 is in place on the watercraft 12. When the windshield device 10 is in an open position as shown in FIG. 1, it protects the driver and other occupants of the boat behind it from sea spray, flying insects, rain, etc. When the occupant of the watercraft, usually its driver, so desires, he or she can fold down the upper windshield portion 14 to a folded down position shown in FIG. 2. In the folded position, the upper windshield portion does not block air coming through the watercraft 12 from the bow. In FIG. 2, the windshield device 10 includes a lower windshield portion 13 comprising four spaced apart lower attachment mechanisms 16, and an upper windshield portion 14 comprising two upper, detachable attachment mechanisms 17. The lower attachment mechanisms 16 are attached to the outer T-top poles 18*a*, with two on each side of the boat, one above the other on each outer pole 18*a*.

The T-top model depicted in FIG. 1 includes front 18*a* and rear 18*b* sets of outer poles, which are connected at their lower ends to the deck of the watercraft 12, and a set of angled inner T-top poles 19. The outer poles are closer to the side walls of the watercraft than the inner poles. The angled inner T-top poles 19 each extend up from an approximate centerline of the watercraft's console 20 in a V-shape out to the outer T-top poles 18*a*, as seen in FIG. 1. Each of the outer T-top poles 18 extends up in a generally vertical, slightly inclined direction from the deck 22 to a corner of the T-top box 21. In the T-top model depicted in FIG. 1, a front set 18*a* of the two sets of four outer poles 18 inclines slightly toward a rear set 18*b* of the four outer poles, and vice versa. The tops of all four outer T-top poles 18 *a, b* are attached to a T-top electronics box 21 in the T-top model depicted. A custom-made T-top cover is usually attached to the T-top box 21 and poles 18, 19. No T-top cover is depicted in FIG. 1 so that the T-top box 21 can be seen. A portion of a T-top cover 23 is shown in FIG. 2. The T-top cover 23 is supported on the tops of the T-top poles 18, 19.

As shown in FIG. 1, a rear (stern) facing portion of the two lower attachment mechanisms 16 on the lower windshield portion 13 are attachable around outermost poles 18*a* of the T-top 11. The two detachable attachment mechanisms 17, which are above them (hence, "upper") on the windshield portion when the device is in an open position, are attachable to the two inner poles 12 of the T-top 11. No additional parts are required for installation or use of the present device. The arrangement of poles 18, 19 in a T-top 11 varies according to the particular manufacture and model of T-top. The T-top may include additional poles. The windshield device 10 can fit on many different pole arrangements according to the placement of the attachment mechanisms 16, 17 on the upper and lower windshield portions 13, 14. Two or four lower attachment mechanisms 16 on the lower windshield portion 13 are alternatively attachable around inner poles of the T-top 11.

For a larger sized windshield device 10, four identical attachment mechanisms 16 are preferably employed on the lower windshield portion 13, with two upper attachment mechanisms 17 on the upper windshield portion 14. The positions of the attachment mechanisms 16, 17 on the upper and lower windshield portions 13, 14 correspond to the desired placement of the windshield device 10 relative to the rest of the watercraft 12, and to the location of the T-top poles 18, 19 behind the windshield device 10.

The T-top cover provides shade and overhead rain protection for the occupants of the watercraft. The present invention provides protection from wind, rain, or hail driving in from the bow of the boat as the boat moves through the water. It also protects a person standing behind it from water spray coming in over the bow, as well as strong winds and flying insects. A tinted windshield device 10 can also provide shade and some protection from ultraviolet light, particularly on a sunny day when the sun is in front of the boat. The windshield device 10 can quickly be deployed in the event of rain. It only takes a few seconds to move the windshield device 10 into the open (up) or folded (down) position.

Figure 4:
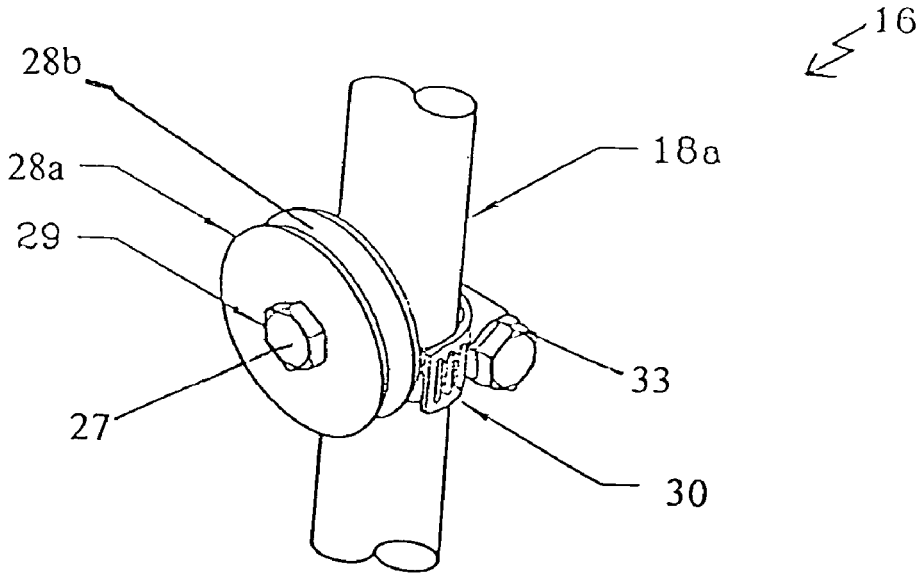
FIG. 4 is a front perspective view of a lower attachment mechanism of a lower windshield portion according to FIG. 1.

As shown in FIG. 4, the lower attachment mechanisms 16 are preferably pivotable, strap-on clamps 16*a*. Each lower windshield portion 13 has a hole drilled through it for each strap-on clamp 16*a*. Each hole is of a sufficient diameter to accommodate the shaft of a screw 27. Each strap-on clamp 16*a* comprises two washers 28 (preferably metal) with one on each side of the windshield portion when the windshield device is installed. It has been found herein that a washer with a diameter approximating the T-top pole diameter should be employed herein in order to distribute the load across a wider area of the windshield and reduce stress in that area. A bendable, stationary strap 30 (preferably a band of thin, stainless steel metal) projects from between the washers 28, extending behind the second washer 28*b* on the inside surface of the lower windshield portion 13. The metal strap 30, which is substantially circular when it is in use, extends out substantially perpendicularly from the planar inner surface of the windshield device 10. Once the screw 27 has been inserted through the holes in the first metal washer 28*b*, the metal strap 30, the lower windshield portion 13, and the second metal washer 28*a*, a nut 29 is placed over the end of the screw shaft during assembly. The windshield device 10 is then ready for installation on the watercraft.

Figure 3:
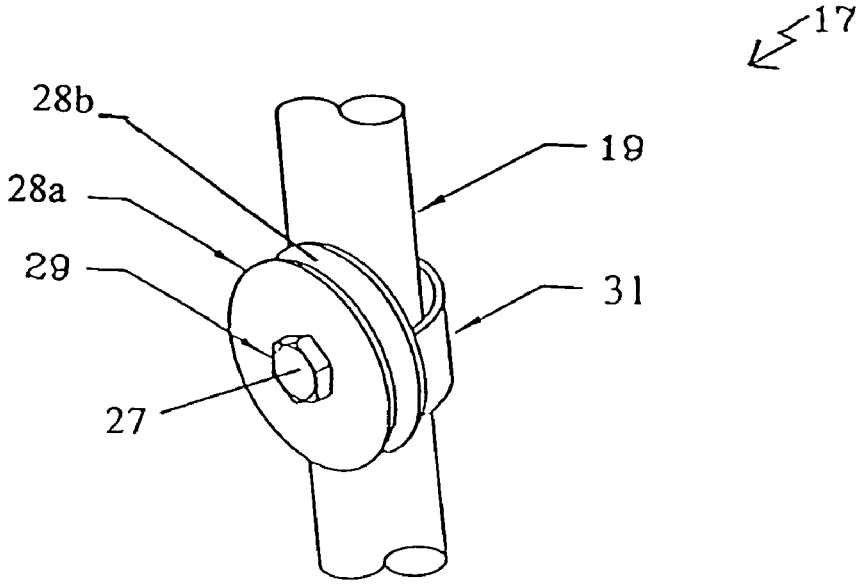
FIG. 3 is a front perspective view of an upper attachment mechanism of an upper windshield portion according to FIG. 1.

As shown in FIG. 3, the upper attachment mechanisms 17 are preferably detachable, pivotable clamps 17*a*, which match the strap-on clamps 16*a*. The upper windshield portion 13 has a hole drilled through it for accommodating each detachable clamp 17*a*. Each hole is of a sufficient diameter to accommodate the shaft of a screw 27. Placement of the holes in the windshield portions 13, 14 corresponds to the location of the T-top poles 18, 19 on which the windshield device is to be placed.

Each detachable clamp 17*a* comprises two washers 28*a*, *b* (preferably metal), with one washer on each side of the windshield portion. Each washer, then, is adjacent an outer or inner surface of the windshield portion. The clamps 16*a*, 17*a* are shown without a windshield portion 13, 14 in FIGS. 3 and 4 for the purposes of illustration. A flexible, detachable attachment strap 31 extends from behind the first washer 28*b* on the inside surface of the lower windshield portion 13. The attachment strap 31 extends out from the inner surface of the windshield device 10, which is the surface that faces the rear, or stern, of the boat when the windshield device is installed on the boat. Once the screw 27 has been inserted through the holes in the first metal washer 28*b* during installation, the attachment strap 31, the upper windshield portion 14, and the second metal washer 28*a*, a nut 29 is placed over the end of the screw shaft. The windshield device 10 is then ready for use. The attachment mechanisms 16, 17 are positioned in the interior of the windshield device 10 and not along its edges. The attachment strap 31 preferably includes two corresponding strips of hook and loop material 32 for attaching the upper attachment mechanisms 17 around the T-top pole.

To use the windshield device 10, the metal straps 30 on the strap-on clamps 16*a* are opened and placed around the T-top poles 18*a*. The metal straps 30 are then tightened by means of a screw fastening device 33 on the metal straps. Once the windshield device 10 is in place on the watercraft, there is no need to detach it from the watercraft, although it can easily be removed by unfastening the metal straps 30, if desired.

To fix the windshield device 10 in the open position (see FIG. 1), the attachment straps 31 on the upper windshield portion 14 are then opened and fastened around the T-top inner poles 19 at the desired location. The attachment straps 31 of the detachable clamps 17*a* are then fastened around the T-top inner poles 19 by pressing the corresponding hook and loop strips 32 together. The user merely pulls a free end of each attachment strap 31 to separate the sets of hook and loop strips 32 and unfasten the upper attachment mechanisms 17. This causes the upper windshield portion 14 to fold down (see FIG. 2).

The clamps 16*a*, 17*a* are self-correcting in that they follow the angle, or taper, of the T-top poles 18, 19. Although they fit snugly around the T-top poles, the clamps 16*a*, 17*a* pivot slightly at the center of each clamp 16*a*, 17*a* to follow the curvature, if any, of the T-top poles 18, 19.

The upper and lower attachment mechanisms 16, 17 alternatively include countersunk screws with rubber stoppers (rather than metal washers) encircling the heads of the screws. Since the screws are countersunk, they are safer and project a cleaner appearance. The rubber stoppers prevent the screws from scratching the windshield material.

Since the flexible hinge 15 must often sustain a beating when the watercraft is in motion, it must be durable even in a marine environment. It must be made of a material that is flexible, waterproof, and rustproof. The hinge 15 is preferably made of a flexible, clear, acrylic material and it is preferably fastened to the windshield portions 13, 14 with a cement adhesive or other suitable adhesive.

Figure 5:
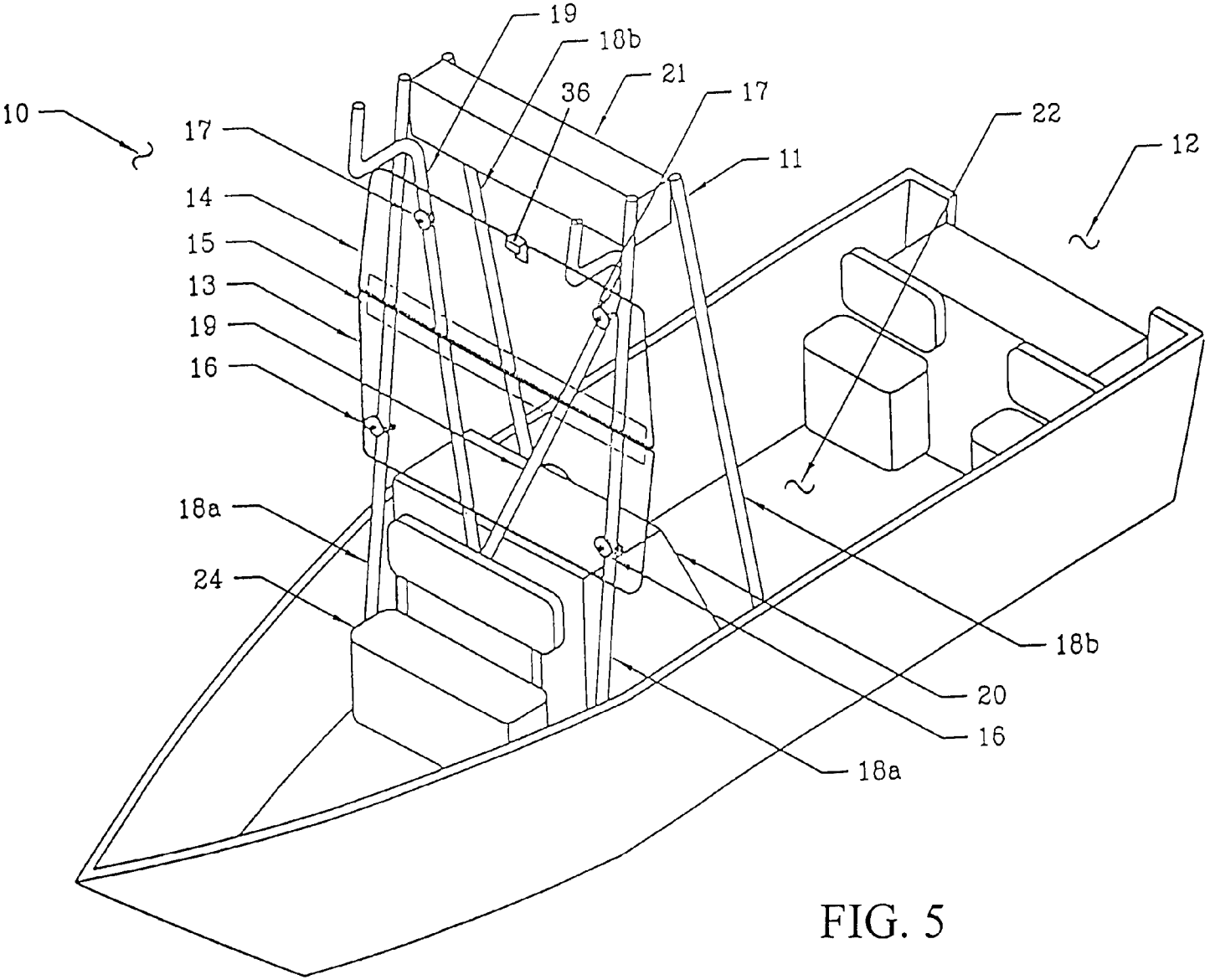
FIG. 5 shows a front perspective view of a foldable windshield device according to the present invention, shown on a T-top watercraft.

As depicted in FIGS. 2 and 5, the windshield device 10 includes an optional mechanical windshield fastener 36, preferably a clasp attached to an outer surface of the upper windshield portion 14. The mechanical fastener 36 maintains the upper windshield portion 14 when the windshield device 10 is in the folded position, so that it does not flap up and down when the boat is in motion. To place the windshield device 10 in the folded position as shown in FIG. 2, the user unfastens the upper attachment mechanisms 17 and drops the upper windshield portion 14 down over the lower windshield portion 13. The user then pushes up the clasp 36, fastening it over the lower edge 37 of the lower windshield portion 13, as shown in FIG. 2. Since a watercraft is often subjected to a great deal of vibration as it impacts waves, especially on a windy day, the fastener 36 prevents the folded down upper windshield portion 14 from banging on the lower windshield portion 13. The windshield device of the present invention is built to withstand repeated jarring impacts and vibration.

Continuing with FIG. 5, the back of the clasp fastener 36 is adhered to the outer surface of the upper windshield portion 14, which is the surface that faces outward, or forward, when the upper windshield portion 14 is in the open position. The clasp fastener 36 fastens over a lower edge 37 of the lower windshield portion 13, when the windshield device 10 is in the folded position. Here, the upper windshield portion 14 is sized so that the clasp fastener 36 fits over the lower edge 37 of the lower windshield portion when the windshield is in the folded position.

In FIGS. 2 and 5, the windshield device 10 includes a lower windshield portion 13 comprising four lower attachment mechanisms 16, and an upper windshield portion 14 comprising two upper, detachable attachment mechanisms 17. Each upper attachment mechanism 17 includes an attachment strap 31. The attachment strap 31 preferably includes two corresponding strips of hook and loop material 32 for removably attaching the upper attachment mechanism 17 around the T-top pole. The upper attachment mechanisms 17, and therefore the upper windshield portion 14 they are attached to, can be detached from the T-top poles 18 by pulling apart the corresponding hook and loop strips 32. The hook and loop strips 32 on each upper attachment mechanism 17 are shown separated in FIG. 2.

Portions of the upper and lower attachment mechanisms 16, 17 are permanently affixed to the windshield portions 13, 14, but not along the edges of the windshield portions. The attachment mechanisms 16, 17 are attached to the windshield device 10.

The mechanical fastener 36 can alternatively be a male cleat member on an upper corner of the upper windshield portion 14, which fits into a corresponding portion of a female cleat member formed along a lower, corresponding corner of the lower windshield portion 13. To fasten the windshield device 10 in the folded position, the user unfastens the detachable attachment mechanisms 17 and drops the upper windshield portion 14 down over the lower windshield portion 13. The user then moves the male cleat member into place in the corresponding portion of the female cleat member. The male cleat member can easily be pulled down when the user desires to place the windshield device 10 in the open position.

No modification of the T-top is required in order to employ the present invention. The windshield device 10 is preferably for use on watercraft having a T-top. The present invention can be installed during or after manufacture of the watercraft.

From the foregoing it can be realized that the described device of the present invention may be easily and conveniently utilized as a fold-down front windshield for a watercraft or the like. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention. Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

BRIEF LIST OF REFERENCE NUMBERS USED IN THE DRAWINGS

10 foldable windshield device
11 T-top
12 watercraft
13 lower windshield portion
14 upper windshield portion
15 hinge
16 lower attachment mechanism
17 upper attachment mechanism
18 outer T-top poles
19 inner T-top poles
20 watercraft console
21 T-top box
22 watercraft deck
23 T-top cover
24 watercraft bench
27 clamp screw
28 clamp washer
29 clamp nut
30 metal strap
31 attachment strap
32 hook and loop strip
33 strap screw fastening device
36 mechanical fastener
37 lower edge of windshield

What is claimed is:

1. A foldable windshield device for attachment to a T-top of a motorized watercraft, the windshield device comprising:

(a) a lower windshield portion comprising at least one lower attachment mechanism;

(b) a foldable upper windshield portion comprising at least one detachable upper attachment mechanism; and (c) a waterproof, durable, flexible, substantially transparent hinge connecting the lower windshield portion to the upper windshield portion;

wherein the upper and lower windshield portions are detachably attachable to at least one pole of the T-top of the watercraft, and the upper windshield portion is detachable from the T-top and foldable over the lower windshield portion; and wherein the attachment mechanism is a strap-on clamp, the strap-on clamp comprising two washers, each washer having a diameter about equal to the outside diameter of the at least one T-top pole.

2. The windshield device according to claim 1, wherein, in an open position, the at least one detachable upper attachment mechanism is attachable to a different one of two of the at least one pole of the T-top than the at least one lower attachment mechanism; and wherein the attachment mechanisms are in the interior of the windshield device and not along its edges.

3. The windshield device according to claim 1, wherein the hinge extends substantially the length of the windshield portions, the windshield portions being generally rectangular in shape and substantially the same length as one another.

4. The windshield device according to claim 1, further comprising a mechanical windshield fastener attached to the upper or lower windshield portion.

5. The windshield device according to claim 2, wherein the opposite sides of the hinge are attached to a lower edge of the upper windshield portion and a corresponding upper edge of the lower windshield portion.

6. The windshield device according to claim 4, wherein the mechanical windshield fastener is a clasp attached to an outer surface of an upper edge of the upper windshield portion for detachable attachment when the windshield is in the folded position.

7. The windshield device according to claim 6, wherein the windshield device comprises four of the at least one lower attachment mechanism, and two of the at least one upper, detachable attachment mechanisms.

8. The windshield device according to claim 2, wherein, in an open position, the detachable upper attachment mechanisms are each attached to one of two inner ones of the poles of the T-top, and the lower attachment mechanisms are each removably attached to one of two outer ones of the poles of the T-top, the inner T-top poles being more proximate to a longitudinal centerline of the watercraft than the outer T-top poles.

9. The windshield device according to claim 1, wherein the attachment mechanism is a strap-on clamp, each strap-on clamp being attached using a hole in one of the windshield portions.

10. A foldable windshield device, for attachment to a T-top of a motorized watercraft, the windshield device comprising:

(a) a lower windshield portion comprising at least one lower attachment mechanism;

(b) a foldable upper windshield portion comprising at least one detachable upper attachment mechanism; and (c) a waterproof, durable, flexible, substantially transparent hinge connecting the lower windshield portion to the upper windshield portion;

wherein the upper and lower windshield portions are detachably attachable to at least one pole of the T-top of the watercraft, and the upper windshield portion is detachable from the T-top and foldable over the lower windshield portion; and wherein the attachment mechanism is a strap-on clamp, the strap-on clamp comprising two washers, each washer having a diameter about equal to the outside diameter of the at least one T-top pole.

11. The windshield device according to claim 9, wherein the lower attachment mechanism comprises: a screw extending through correspondingly sized holes in a first washer, a stationary strap, the lower windshield portion, and a second washer, respectively.

12. The windshield device according to claim 11, wherein the stationary strap extends out substantially perpendicularly from the inner surface of the windshield device.

13. A foldable windshield device for attachment to a T-top of a motorized watercraft, the windshield device comprising:

(a) a lower windshield portion comprising at least one lower attachment mechanism;

(b) a foldable upper windshield portion comprising at least one detachable upper attachment mechanism; and (c) a waterproof, durable, flexible, substantially transparent hinge connecting the lower windshield portion to the upper windshield portion;

wherein the upper and lower windshield portions are detachably attachable to at least one pole of the T-top of the watercraft, and the upper windshield portion is detachable from the T-top and foldable over the lower windshield portion; and wherein the detachable upper attachment mechanism is a detachable clamp comprising: a screw inserted through correspondingly sized holes in a first washer, a detachable strap, the upper windshield portion, and a second washer, respectively.

14. The windshield device according to claim 13, wherein the detachable strap comprises hook and loop strips.

15. The windshield device according to claim 13, wherein each washer is adjacent an outer or inner surface of the windshield portion, the detachable strap extending out from the inner surface of the windshield device.

16. The windshield device according to claim 13, wherein each washer has a diameter about equal to the outside diameter of the at least one T-top pole.

17. The windshield device according to claim 10, wherein the strap-on clamp further comprises a screw fastening device.

* * * * *